United States Patent [19]

Erikson

[11] Patent Number: 4,575,312

[45] Date of Patent: Mar. 11, 1986

[54] IMPELLER

[75] Inventor: Magnus Erikson, Johanneshov, Sweden

[73] Assignee: ITT Industries, Inc., New York, N.Y.

[21] Appl. No.: 670,427

[22] Filed: Nov. 9, 1984

Related U.S. Application Data

[63] Continuation of Ser. No. 390,084, Jun. 2, 1982, abandoned, which is a continuation-in-part of Ser. No. 140,892, Apr. 16, 1980, abandoned.

[51] Int. Cl.[4] ..... F04D 1/04

[52] U.S. Cl. ..... 416/179; 415/206; 415/213 R; 416/144

[58] Field of Search ..... 416/144, 186 R, 179, 416/19; 415/206, 213 R

[56] References Cited

U.S. PATENT DOCUMENTS

| | | | |
|---|---|---|---|
| 1,470,607 | 12/1923 | Hazell | 416/144 |
| 1,754,992 | 4/1930 | Fabrin | 415/206 X |
| 2,272,469 | 2/1942 | Lannert | 415/206 X |
| 2,655,868 | 10/1953 | Lindau et al. | 415/206 X |
| 2,741,992 | 4/1956 | Glazebrook | 416/144 X |
| 2,853,019 | 9/1958 | Thornton | 416/186 R X |
| 3,082,695 | 3/1963 | Buschhorn | 416/DIG. 2 X |
| 3,261,297 | 7/1966 | Daniel | 415/206 X |
| 3,732,032 | 5/1973 | Daneel | 416/144 |

FOREIGN PATENT DOCUMENTS

| | | | |
|---|---|---|---|
| 156379 | 11/1951 | Australia | 416/144 |
| 457204 | 3/1928 | Fed. Rep. of Germany | 415/206 |
| 42800 | 6/1970 | Finland | 416/144 |
| 1274289 | 9/1961 | France | 415/206 |
| 189936 | 6/1937 | Switzerland | 415/206 |

*Primary Examiner*—Everette A. Powell, Jr

*Attorney, Agent, or Firm*—John T. O'Halloran; Robert P. Seitter

[57] ABSTRACT

The invention is related to an impeller for a single vane type of centrifugal pump. In order to diminish the risk of clogging of the pump when pumping a fluid having a large impurity content, a vane having varying thickness is provided. In this manner, the speed reduced in the channel is limited resulting in a favorable flow pattern. Additionally, the vane may be made hollow in order to reduce unbalance problems.

8 Claims, 30 Drawing Figures

IMPELLER

This application is a continuation of application Ser. No. 390,084 filed June 2, 1982, now abandoned, which application is a continuation-in-part of application Ser. No. 140,892 filed Apr. 16, 1980, now abandoned.

BACKGROUND OF THE INVENTION

This invention is directed to an impeller for centrifugal pumps particularly for use in pumping of fluent media. More precisely, the invention is directed to an impeller of the so-called single vane type, which means that the impeller is provided with one single vane which goes helically around the impeller either partly or perhaps entirely. Cover discs are located at the helical edges of the vane and cooperate with it to form a channel.

Pump impellers of the type referred to are primarily used for pumping of liquids containing solid bodies, for instance, sewage water. The advantage of this configuration is that the risk of clogging decreases if only one vane is used. In some instances, a certain minimum thrulet in a pump impeller for sewage pumps is prescribed by Governmental regulation. Such thrulet can only be fulfilled by a single vane impeller if reasonable dimensions are maintained.

Previously known impellers of the single vane type have the vane formed of generally constant thickness between the cover discs and leading edge near the pump inlet to the trailing edge near the pump outlet. One such impeller of this type is shown in the Swedish published patent application No. 7,806,198-3.

Such impellers do have certain disadvantages. As the vane thickness is constant, the channel which is formed by the vane has a constant or sudden increasing cross-section from the inlet towards the direction of the pump outlet. This steady increase is most significant near the inlet. This rapid increase in cross-sectional area results in a rapid decrease in fluid velocity and local pressure which may cause an undesirable turbulence and possible cavitation. Additionally, an increased risk of solid body collection, especially at the leading edge of the vane exists which would result in a decreased cross-sectional area at that location causing increased probability of clogging and/or decreased pump efficiency. Any clogging of the impeller results in an increased load on the driving unit which sometimes triggers the overload protection devices resulting in work stoppage and requiring servicing of the pump.

OBJECTS OF THE INVENTION

It is an object of this invention to obtain an impeller of the single channel type where the speed reduction of the fluid flow is avoided as much as possible. This is obtained according to the invention by a vane having varying thickness thus providing a channel formed by the vane and cover discs of the impeller or surrounding pump housing which is substantially constant or only slightly increasing in the cross-sectional area taken normal to the direction of flow toward the pump outlet. This results in the elimination of fluid diffusion in the area near the impeller.

BRIEF DESCRIPTION OF THE DRAWINGS

The invention is described more specifically hereinafter with reference to the enclosed drawings wherein.

DESCRIPTION OF THE PREFERRED EMBODIMENTS

Figure 1:
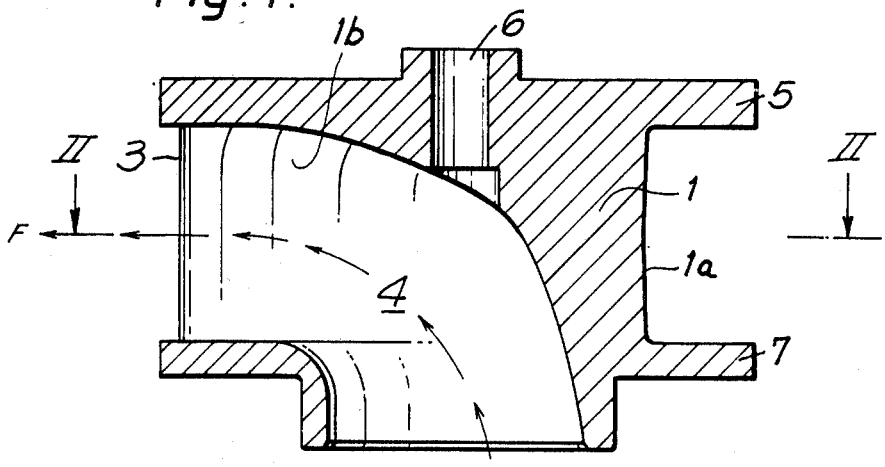
FIG. 1 shows an axial section through an impeller, according to the invention.

In the drawings, there is shown an impeller vane 1 having a leading edge 2 and a trailing edge 3. As can be seen in the drawing the vane 1 is helical in plan view and extends through no more than 360° and, preferably, through less than 360°. There is also shown a channel 4 formed by the vane 1 and a pair of generally parallel cover discs 5 and 7 between which the ends of the vane extend. A threaded opening 6 extends through cover disc 5 for coupling with a shaft that is connected to a driver for rotating the impeller in a housing as is conventional in the art.

It should be understood by those skilled in the art that the channel 4 is a suction channel that receives inlet flow at an opening extending through the disc 7 and discharges it through the opening between the leading and trailing edges 2 and 3, respectively, of the vane 1. Such flow is illustrated in the drawing by the arrow F. As also visible in the drawing, the inlet opening is generally coaxial with the impeller axis of rotation (the axis of threaded spring 6) and the discharge opening is eccentric to that axis. Because of this, the cross-sectional configuration or shape of the channel 4 changes from the inlet to the discharge opening.

Figure 2:
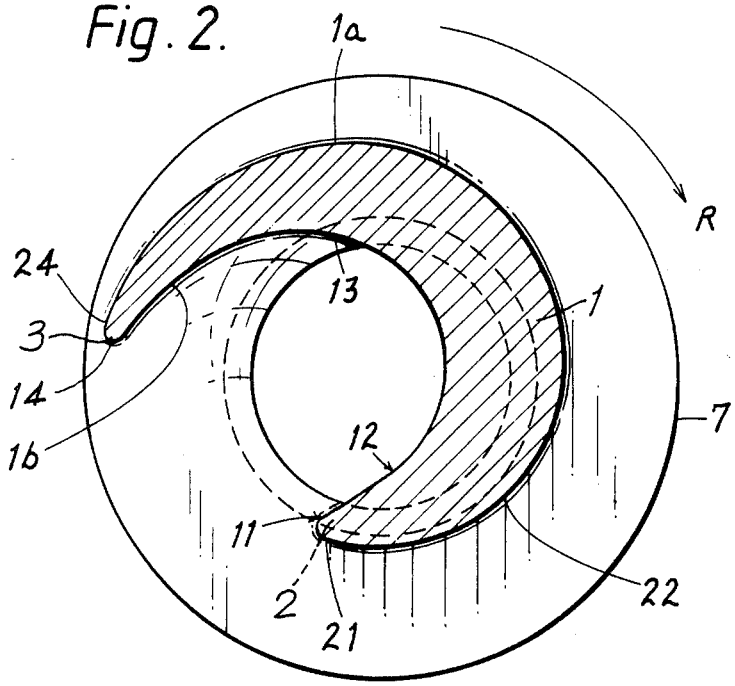
FIG. 2 shows a radial section.
Figure 3:
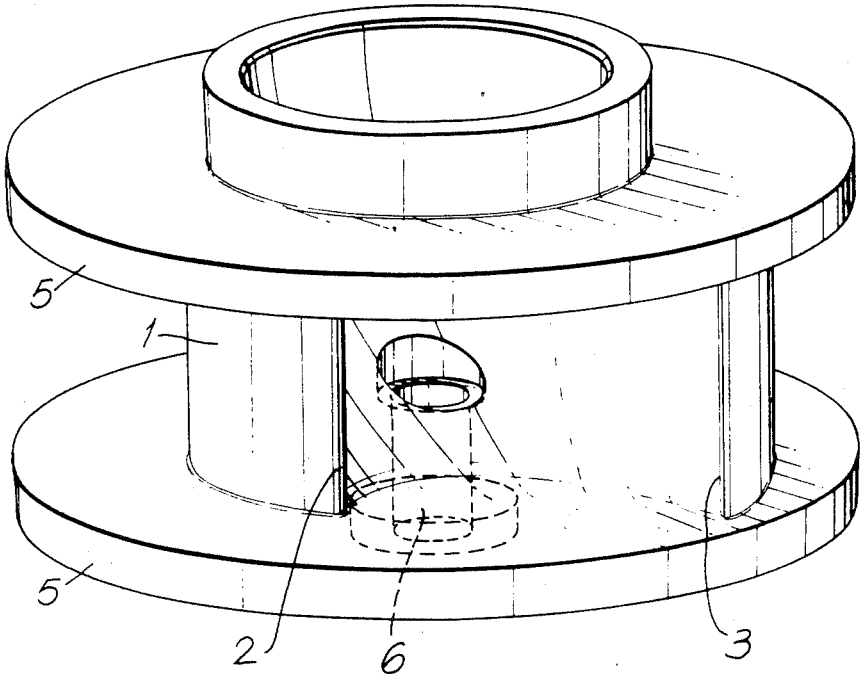
FIG. 3 shows a perspective view of the same impeller.
Figure 4:
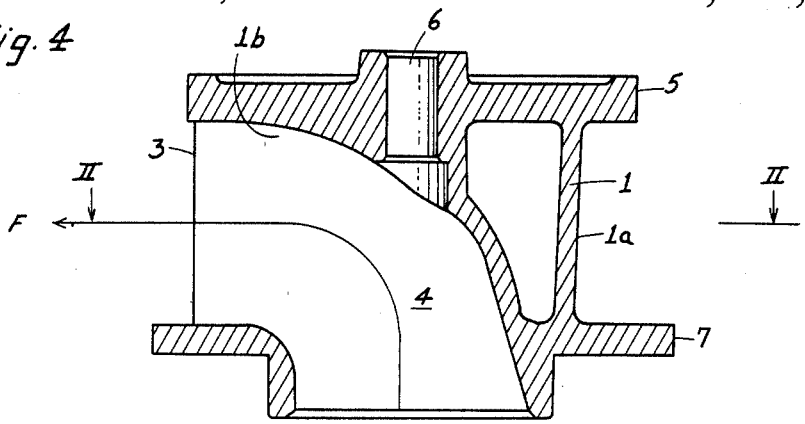
FIG. 4 is an axial section through an impeller in accordance with another embodiment of the invention.
Figure 5:
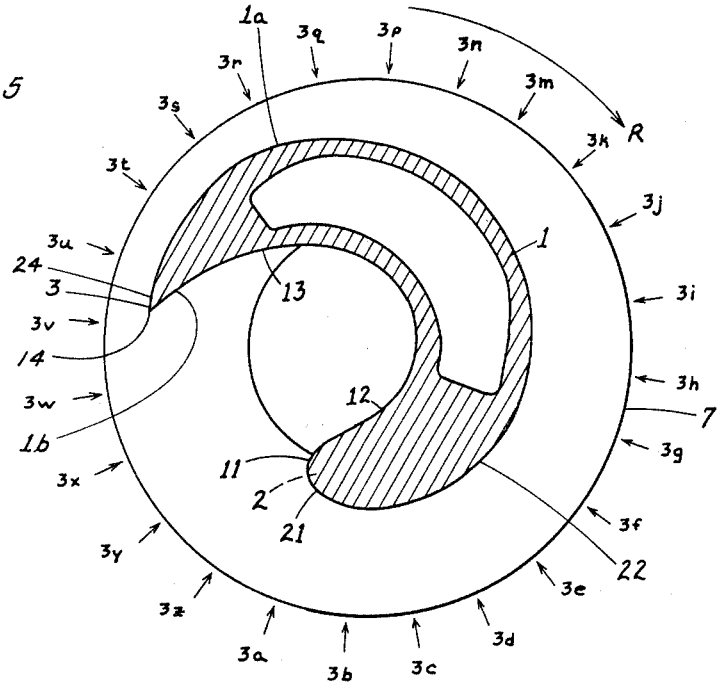
FIG. 5 is a radial section through the impeller shown in FIG. 4.

It should be understood by those skilled in the art that, in use, the impeller is contained in a housing and rotated in the direction of the arrow R shown in FIGS. 2 and 5 of the drawing so that the fluid discharged through the opening between the vane edges 2 and 3 is in a channel formed between the outer surface 1*a* of the vane and the housing. The outer surface 1*a* of the vane is a working surface that pressurizes the fluid and discharges it through a discharge port formed in the housing.

Unlike previously known impellers of the single vane type, an impeller according to the present invention has a vane 1 with varying thickness in the direction of flow so that the channel 4, which is formed by the vane 1 and the cover discs 5 and 7, has a cross-sectional area which is substantially constant or only slightly increasing in the direction of the outlet. This means that any cross-section of the channel 4 which is taken normal to the direction of flow has an area that is substantially constant or only slightly increasing with the direction of flow. This reduces the aforementioned risks of clogging.

Figure 6A:
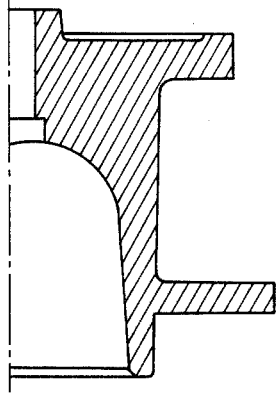
FIGS. 6*a* through 6*z* are section views of the impeller shown in FIGS. 4 and 5 taken along the lines 3*a* through 3*z*, respectively.
Figure 6B:
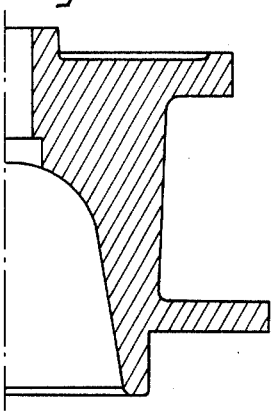
Figure 6C:
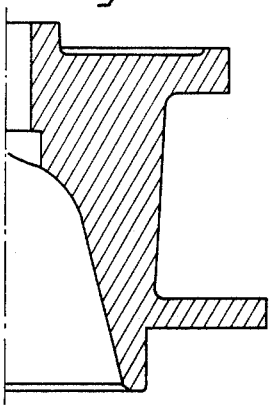
Figure 6G:
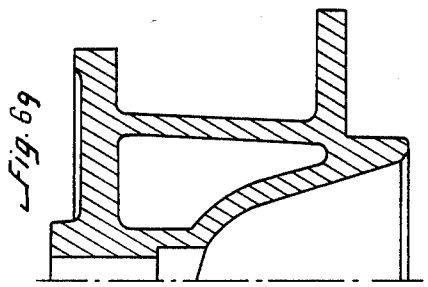
Figure 6K:
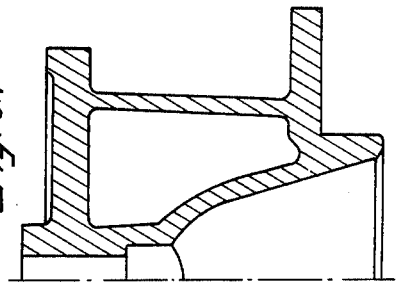
Figure 6F:
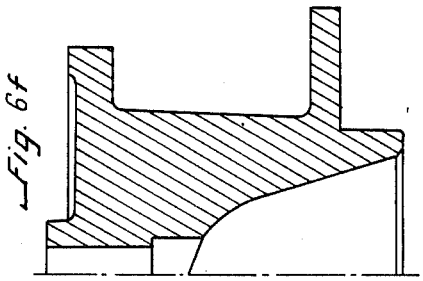
Figure 6J:
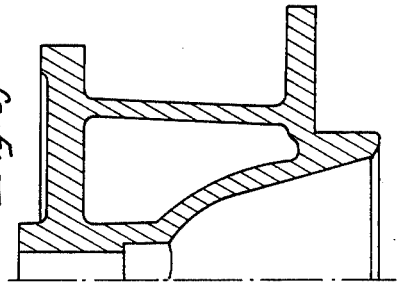
Figure 6E:
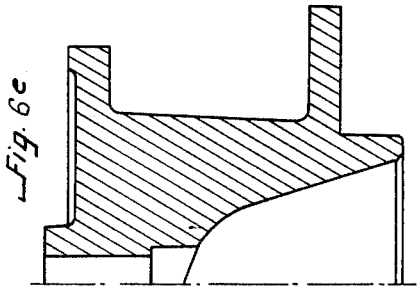
Figure 6I:
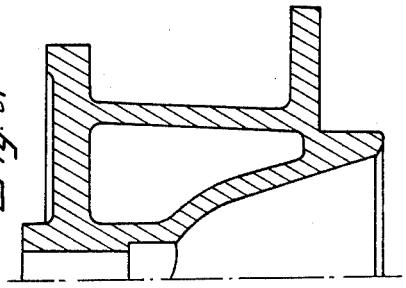
Figure 6D:
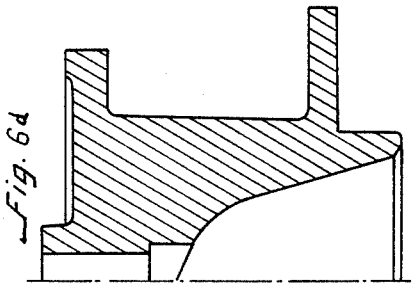
Figure 6H:
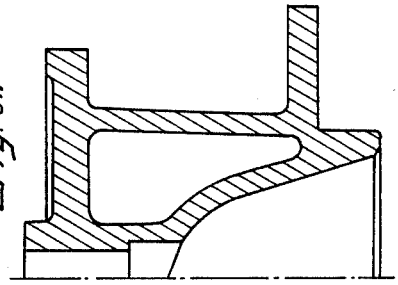
Figure 6Q:
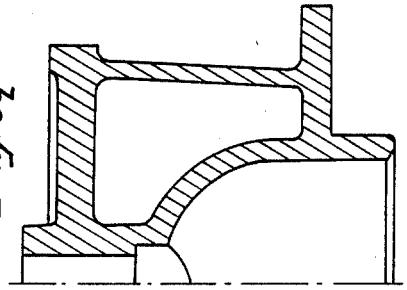
Figure 6U:
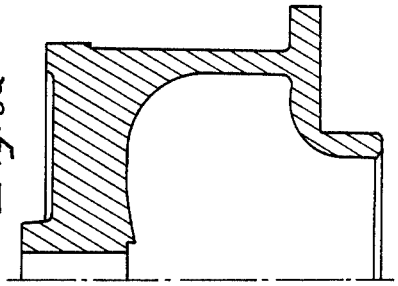
Figure 6P:
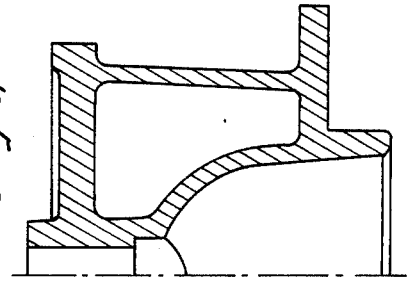
Figure 6T:
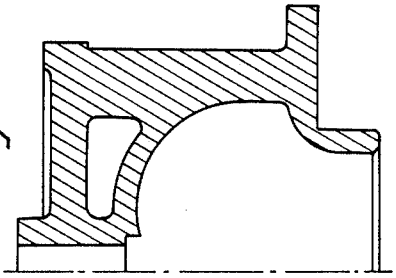
Figure 6N:
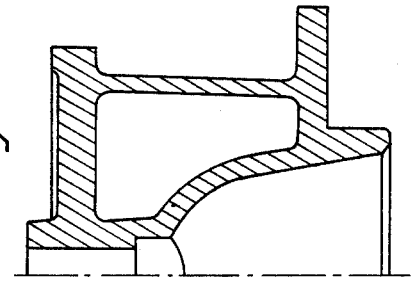
Figure 6S:
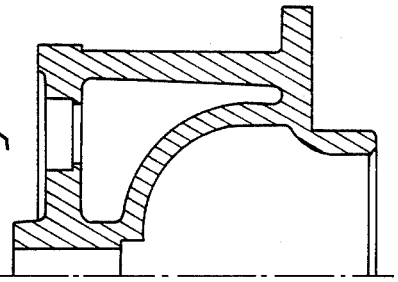
Figure 6M:
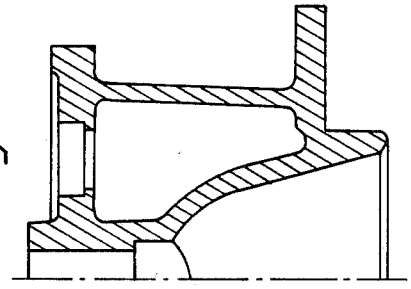
Figure 6R:
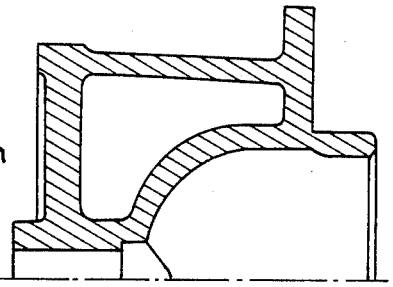
Figure 6X:
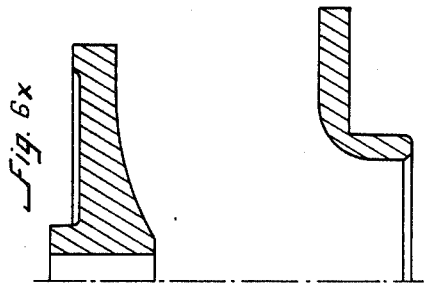
Figure 6Z:
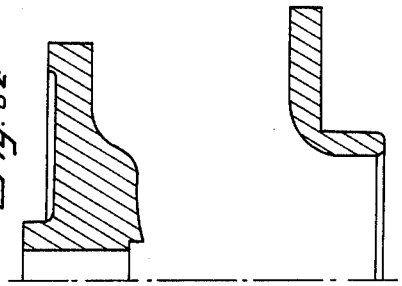
Figure 6W:
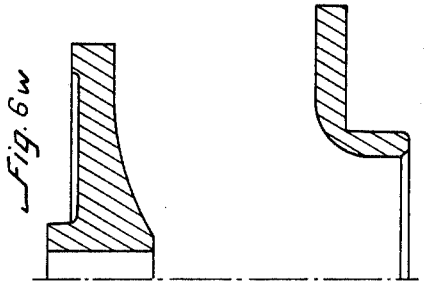
Figure 6Y:
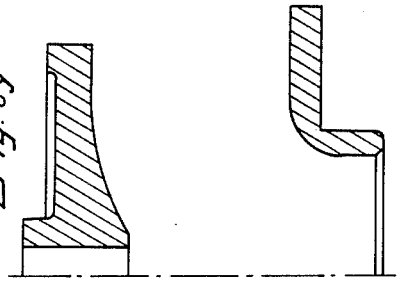
Figure 6V:
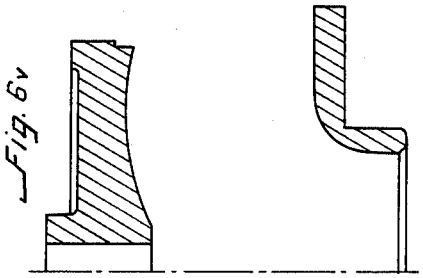
Figure 7:
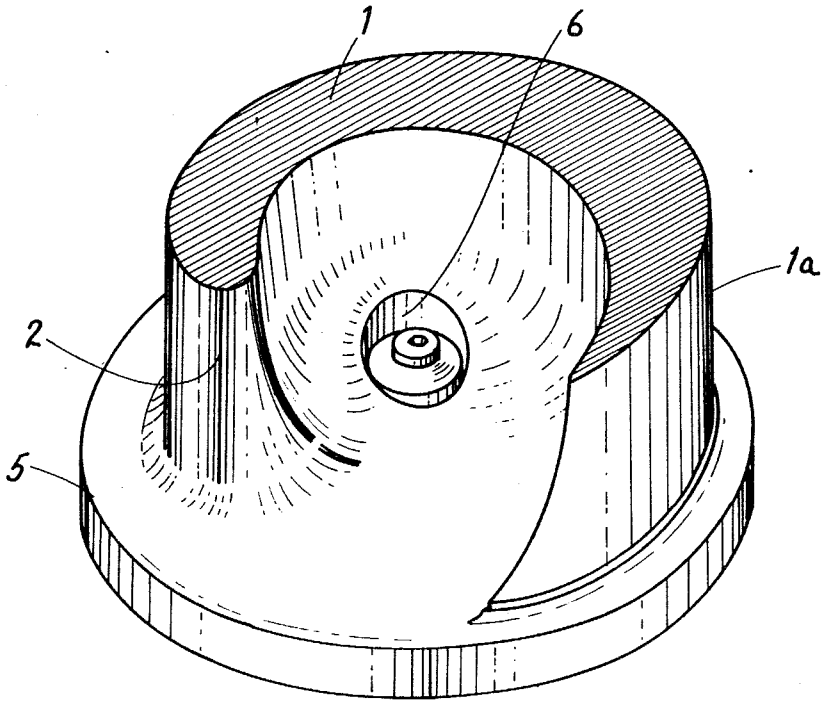
FIG. 7 is a perspective view of the impeller shown in FIGS. 1–3 with a cover plate removed for the sake of clarity.

The changing cross-sectional shape and substantially constant area of channel 4 can be understood from a study of FIGS. 6*a*–6*z* of the drawing. It can be realized that the thickness of the vane 1, that is, the distance between surfaces 1*a* and 1*b*, varies along any radial plane through the vane and also along any plane extending axially through the vane, i.e., between the cover plates 5 and 7. The thickness variation in the radial plane can best be seen in FIGS. 2, 5 and 7 and the axial variation can best be seen in FIG. 7 by inspecting the leading edge 2 in FIG. 7. To accomplish the constant or only slightly increasing area of the channel 4, the vane 1 should be thickest adjacent the inlet opening, that is, adjacent cover plate 7 and thinnest adjacent the opposite cover plate 5.

Known impellers of the single channel type often get a layer of particles accumulating near the leading edge 2. This layer often gives the vane a new profile which is undesirable because of the increased clogging tendency, resulting in the risk of overload. In addition to the overload risk, such deposits often result in unbalancing of the impeller resulting in increased strain and wear on the bearings resulting in shorter life span. According to the invention, a proper profile is formed initially in the vane with the result that no deposits form on the impeller resulting in potential clogging or rapid deterioration of the pump.

Additionally, the vane may have a single curved pressure surface and a suction surface, which is either a single curved or a double curved surface. In another embodiment, the suction surface and the pressure surface may be double curved. Referring to FIG. 2, a vane having a double curved suction surface and a single curved pressure surface is illustrated. The inside surface of the vane in FIG. 2 is composed of three parts. The first portion between points 11 and 12 is straight, having no curve whatsoever. That portion between points 12 and 13 is a smooth curve equidistant from point A. This is a double curved portion of the surface. That portion of the inner surface between points 13 and 14 is an additional double curved portion of the surface having its axis located at point B. It may be appreciated then that the inside surface is double curved. The outside surface has a helical form where, however, the surface between Nos. 21 and 22 has an almost constant radius.

The vane 1 may be solid as shown in FIGS. 1–3 and 7; however, in a preferred embodiment of the invention, the vane is hollow, see FIGS. 4, 5 and 6*a* through 6*z*, in order to diminish its weight and thus the need for careful balancing of the pump parts.

The vane 1, may be formed differently according to the optimal design conditions of the pump. Different conditions may be required where the pump medium, impeller speed, volume of flow and fluid head are varied. Depending on these criteria, the impeller is formed with a greater or lesser pronounced bulbform near the leading edge of the vane and with double or single bent sides. A common feature for all embodiments are the different thicknesses of various portions of the vane.

In a preferred embodiment, the vane may have a bulbform with its greatest thickness located at a portion of the vane between 20% to 40% displaced from the front edge of the vane.

According to this invention, an impeller may be designed which has a radically diminished risk of clogging, and increased liquid thruput, having better flow efficiency and a better balancing of the impeller without abandoning the minimum free thrulet.

I claim:

1. An impeller for use in a centrifugal pump, said impeller comprising cover discs connected to each other by a single generally helical vane having an outer surface and an inner surface, said outer surface being eccentric with respect to said discs whereby it forms a pressure surface, said discs and said inner surface of said vane defining a channel having an inlet coaxial with the impeller axis of rotation and being formed by an opening in one of said discs and an outlet eccentric to said axis, said circumferential extent of said vane being less than 360° so that it has a leading edge and a trailing edge with the space between said edges forming said outlet, the thickness of said vane varying in both its radial and axial directions such that the cross-section of the channel taken normal to the axis of flow through the channel has a varying shape and an area having a range from substantially constant to only slightly increasing.

2. An impeller in accordance with claim 1 wherein said cross-section is substantially constant.

3. The impeller according to claim 1 wherein the vane has a bulbform having its greatest thickness located at a portion of the vane between 20° to 40° displaced from the leading edge of the vane.

4. An impeller according to claim 1 wherein the vane is hollow.

5. An impeller according to claim 1 wherein the vane is solid.

6. An impeller according to claim 1 wherein the vane has a single curved pressure surface and a double curved suction surface.

7. The impeller claimed in claim 1 wherein the vane has a single curved suction surface and a single curved pressure surface.

8. The impeller according to claim 1 wherein, the vane has a double curved suction surface and a double curved pressure surface.

* * * * *

REEXAMINATION CERTIFICATE (1056th)

United States Patent [19]

Erikson

[11] B1 4,575,312

[45] Certificate Issued May 16, 1989

[54] IMPELLER

[75] Inventor: Magnus Erikson, Johanneshov, Sweden

[73] Assignee: ITT Industries, Inc., New York, N.Y.

Reexamination Request:
No. 90/001,382, Nov. 20, 1987

Reexamination Certificate for:

| | |
|---|---|
| Patent No.: | **4,575,312** |
| Issued: | **Mar. 11, 1986** |
| Appl. No.: | **670,427** |
| Filed: | **Nov. 9, 1984** |

Related U.S. Application Data

[63] Continuation of Ser. No. 390,084, Jun. 2, 1982, abandoned. which is a continuation-in-part of Ser. No. 140,892, Apr. 16, 1980, abandoned.

[51] Int. Cl.[4] ..... F04D 1/04

[52] U.S. Cl. ..... 416/179; 415/206; 415/213 R; 416/144

[58] Field of Search ..... 416/144, 179, 19, 186 R; 415/206, 213 R, 207-213 B

[56] References Cited

U.S. PATENT DOCUMENTS

| | | | |
|---|---|---|---|
| 1,470,607 | 10/1923 | Hazell | 416/144 |
| 1,754,992 | 4/1930 | Fabrin | 416/144 |
| 2,655,868 | 10/1953 | Lindau et al. | 416/19 |
| 2,741,992 | 4/1956 | Glazebrook | 416/144 |
| 2,853,019 | 9/1958 | Thornton | 416/144 |
| 3,261,297 | 7/1966 | Daniel | 415/206 |
| 3,732,032 | 5/1973 | Daneel | 416/19 |
| 3,971,513 | 7/1976 | Klip | 415/121 B X |

FOREIGN PATENT DOCUMENTS

| | | | |
|---|---|---|---|
| 457204 | 3/1928 | Fed. Rep. of Germany | 415/206 |
| 1274289 | 9/1961 | France | 415/206 |
| 491020 | 2/1954 | Italy | 416/144 R |
| 24128 | 10/1969 | Japan | 416/144 |
| 189936 | 6/1937 | Switzerland | 415/206 |
| 574079 | 12/1945 | United Kingdom | 416/19 |
| 2054748 | 2/1981 | United Kingdom | 416/19 |

OTHER PUBLICATIONS

"Pumpen regeln Wasserhaushalt", by H. Kissinger and published in VDI-Nachrichter, No. 25, 6/65, p. 6.

*Primary Examiner*—Everette A. Powell, Jr.
*Attorney, Agent, or Firm*—Menotti J. Lombardi

[57] ABSTRACT

The invention is related to an impeller for a single vane type of centrifugal pump. In order to diminish the risk of clogging of the pump when pumping a fluid having a large impurity content, a vane having varying thickness is provided. In this manner, the speed reduced in the channel is limited resulting in a favorable flow pattern. Additionally, the vane may be made hollow in order to reduce unbalance problems.

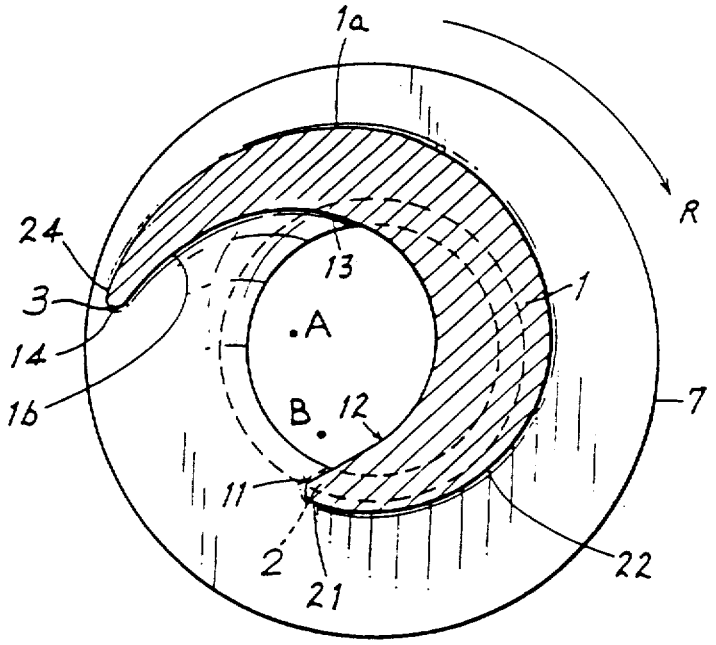

REEXAMINATION CERTIFICATE ISSUED UNDER 35 U.S.C. 307

THE PATENT IS HEREBY AMENDED AS INDICATED BELOW.

The drawing figures have been changed as follows: Reference characters A and B have been added to FIG. 2.

AS A RESULT OF REEXAMINATION, IT HAS BEEN DETERMINED THAT:

The patentability of claims 1–8 is confirmed.

* * * * *